United States Patent [19]

Egerer

[11] Patent Number: 5,054,167

[45] Date of Patent: Oct. 8, 1991

[54] COMBING NEEDLE FOR SPINNING MACHINES

[75] Inventor: Josef Egerer, Schwabach, Fed. Rep. of Germany

[73] Assignee: Staedtler & Uhl, Schwabach, Fed. Rep. of Germany

[21] Appl. No.: 593,446

[22] Filed: Oct. 4, 1990

[30] Foreign Application Priority Data

Nov. 15, 1989 [DE] Fed. Rep. of Germany ..... 3937899

[51] Int. Cl.[5] ..... D01G 19/24; D01G 15/84

[52] U.S. Cl. ..... 19/218; 19/114

[58] Field of Search ..... 19/114, 2, 218, 220, 19/221, 222

[56] References Cited

U.S. PATENT DOCUMENTS

| | | | |
|---|---|---|---|
| 2,977,642 | 4/1961 | Edfors | 19/218 |
| 2,986,779 | 6/1961 | Lettermann | 19/218 |
| 4,575,902 | 3/1986 | Alazet | 19/2 |
| 4,928,356 | 5/1990 | Egerer | 19/129 R |

FOREIGN PATENT DOCUMENTS

| | | | |
|---|---|---|---|
| 239568 | 6/1960 | Australia | 19/114 |
| 685984 | 5/1964 | Canada | 19/114 |
| 1238387 | 7/1959 | France | 19/114 |
| 933834 | 8/1963 | United Kingdom | 19/114 |

*Primary Examiner*—Werner H. Schroeder
*Assistant Examiner*—John J. Calvert
*Attorney, Agent, or Firm*—Browdy and Neimark

[57] ABSTRACT

For achieving the cleaning of the space between the combing elements and thus for attaining a considerably improved combing effect in a combing element, in particular a needle or a stamped sawtooth element, for spinning machines, the combing element is provided with at least one compressed air channel in the shape of a groove (4) in the combing element itself, leading from a fastening area in the direction of the tip area (3).

6 Claims, 2 Drawing Sheets

COMBING NEEDLE FOR SPINNING MACHINES

FIELD OF THE INVENTION

The invention relates to a combing element for spinning machines, in particular a needle or stamped sawtooth element, where compressed air can be fed into the area of the combing tips, as well as to needle bars or bars of stamped elements.

BACKGROUND OF THE INVENTION

Combing elements of this general type are combined in the form of needle bars or bars of stamped sawtooth elements and are installed in spinning machines for the purpose of removing impurities contained in wool or cotton fibers and to align the fibers so that they are generally parallel. The pieces of straw or burls combed out of the wool or cotton are deposited at the combing elements. In addition, short pieces of fiber and other impurities may be deposited in the gaps between the combing elements and in this way considerably hamper their combing action. It is known to provide cleaning blades for cleaning top combs constructed from needle bars, which clean the top combs subsequent to the combing cycle. Furthermore, the use of cleaning brushes is known in connection with wool combing machines. These already known cleaning means can only be used to a limited extent in connection with top combs and cannot be used at all in connection with other combing devices, such as rotating combing units.

A completely novel way for cleaning needle bars, in particular of top combs, has been disclosed in U.S. Pat. No. 4,928,356 where in accordance with the exemplary embodiments described therein compressed air is supplied via an air chamber, laterally arranged on the needle bars, which enters the combing tip area of the needles below the lower edge of the cover plates of the needle bars and cleans it of impurities and short fibers deposited there. This concept of compressed air cleaning has proven to be excellent and has resulted in a considerable improvement of the combing quality.

SUMMARY OF THE INVENTION

Based on this general concept, it is an object of the present invention to provide a combing element of the previously described type in such a way that it becomes possible to achieve compressed air cleaning in connection with all types of spinning machines without any substantial changes in the customary combing installations per se, and with as little structural effort as possible.

This object is attained in accordance with the invention by providing the combing element with at least one compressed air channel in the shape of a groove in the combing element itself, leading from a fastening area in the direction of and toward the tip area.

By means of this construction in accordance with the present invention, it is no longer necessary to dispose separate air chambers which guide the air into the tip area on the combing elements. Instead, the combing elements can be fixed in the customary way within the combing installation and only compressed air 15 supply lines extending as far as the fastening area of the combing elements are required. The air channels formed by the grooves can be provided without problems during the manufacturing process of the combing elements, because punching and stamping tools are already being used in connection with the customary manufacturing processes anyway.

If the combing element is designed in the form of a combing needle, such needle may be provided in an essentially rectangular or oval basic shape with grooves cut parallel to the longitudinal axis of the needle from the direction of two oppositely located longitudinal sides of the cross section. Looking at the needle cross section, the combing needle is thus seen to have grooves in its opposite sides, and by placing a plurality of such needles next to each other, the grooves of two needles result in a closed channel.

The grooves preferably extend from the shank end of the needle as far as the area of the free protrusion of the needle, so that impurity deposits there are dependably removed by the stream of air. In cross section the grooves may have the shape of a shallow V or of a segment of a parabola, i.e. a rounded-off cross-sectional shape, where longitudinally extending, non-deformed edge areas remain laterally adjacent to the grooves. When lining up the needles, these non-deformed edge areas act like sealing lips which are placed flat against each other, so that dependable side sealing of the air channels formed by the grooves is achieved. The non-deformed edge areas of the grooves preferably extend along the needles in such a way that, when a plurality of such needles are lined up, a closed compressed air channel extending from the shank end as far as the area of the protrusion of the tips is formed between each of two needles.

The invention also relates to a needle bar, consisting of a plurality of needles with a cover plate on both of their sides, where compressed air is supplied to the compressed air channels between the cover plates extending crosswise to the longitudinal direction of the needles and extending upwardly beyond their shank ends. Thus, the cover plates can also simultaneously form a compressed air supply channel at the upper section of the needles in an advantageous manner.

The invention further relates to combing elements which are in the form of stamped sawtooth elements, where at least one compressed air supply channel is provided extending through a foot section of the combing segment terminates in a compressed air distribution channel. In an advantageous manner, compressed air channels from the compressed air distribution channel terminate in the valley portion between two tips of the stamped sawtooth element.

Accordingly, it is therefore also possible in connection with stamped sawtooth elements to attain cleaning of the tip area by means of compressed air in an extraordinarily effective and, at the same time production-technologically simple, manner. The invention is realized, in particular in connection with stamped sawtooth elements, in such a way that at least one compressed air channel extending through a foot section of the combing segment is provided which terminates in a compressed air distribution channel. Compressed air channels from the compressed air distribution channel preferably terminate in the valley portion between two tips of the stamped sawtooth element, so that dependable removal of impurities and short fibers deposited there is achieved.

In connection with a bar comprising a plurality of stamped sawtooth elements combined by means of at least one support element, the compressed air channels are formed by two adjoining grooves of 10 each of two adjoining stamped sawtooth elements. Therefore the stamped sawtooth elements of such a bar can be combined into a bar by means of customary, proven fastening technology and can be fixed, for example, in the form of such a bar on combing segments of a combing machine.

BRIEF DESCRIPTION OF DRAWING

The invention will be described in detail below by means of preferred exemplary embodiments in connection with the drawings.

DETAILED DESCRIPTION OF EMBODIMENTS

Figure 1:
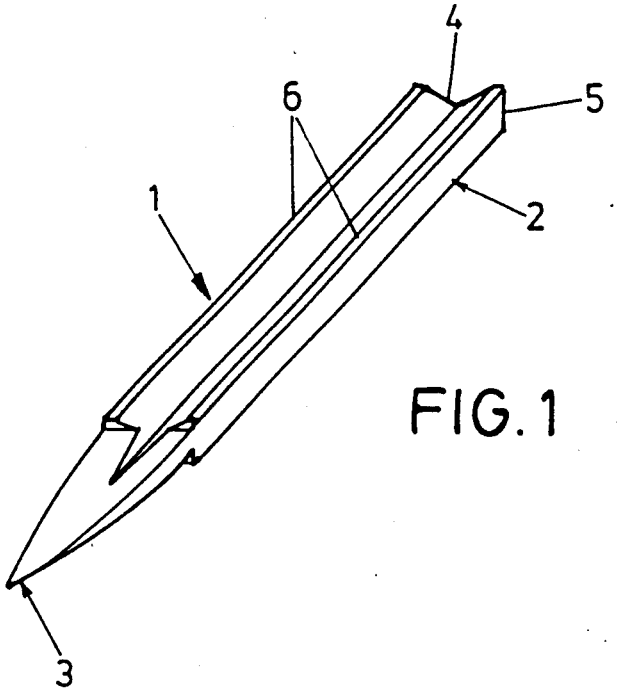
FIG. 1 is a perspective view of a first embodiment of a combing needle designed in accordance with the invention.

A combing element in the form of a combing needle 1 is shown in FIG. 1, comprising a shank 2 and a tip 3. The shank 2 has an essentially rectangular cross section, and both longitudinal sides of the cross section are provided with grooves 4, extending in the longitudinal direction from the shank end 5 up to the area of the tips 3.

The grooves 4 have a V-shaped cross section, and a non-deformed, flat edge area 6 in the shape of sealing lips remains on both sides of each groove 4. If two appropriately designed combing needles 1 are placed against each other with the longitudinal sides of their cross section in such a way that the flat-stamped tips 3 are parallel, the edge areas 6 adjoin and define an air channel 8 (see FIG. 3), rhomboidal in cross section, formed by two adjoining grooves 4 of neighboring needles 1.

Figure 2:
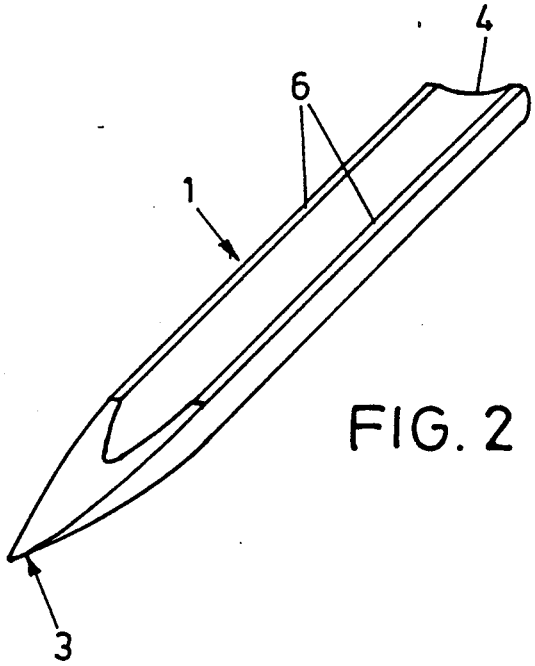
FIG. 2 is a view, corresponding to FIG. 1, of a second embodiment.

An embodiment is shown in FIG. 2, in which the groove 4*a* is rounded and in the shape of a section of a parabola in cross section. There, too, nondeformed edge areas 6 are provided which allow tight adjacent alignment of the needles 1 while forming air channels 8 therebetween.

Figure 3:
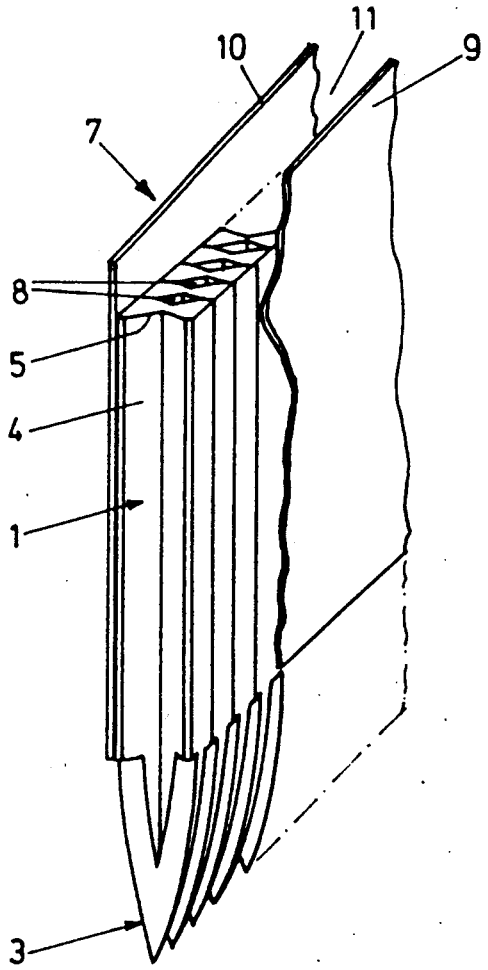
FIG. 3 is a partial perspective view of a needle bar in accordance with the invention, in which the front cover plate is shown partially broken away.

FIG. 3 shows a needle bar 7 comprising a plurality of the needles 1 shown in FIG. 1, which are aligned with the longitudinal sides of their cross sections in such a way that two grooves 4 form air channels 8 which are rhomboidal in cross section. On both sides of the needles 1, cover plates 9 and 10 are provided in a manner known per se, which extend upwardly with their upper sections beyond the shank end 5 of the needles 1 and extend downwardly as far as the start of the area of the tips 3. In this manner an air supply channel 11 is created between the upper sections of the cover plates 9, 10 and the ends 5 of the needles 1, which can be closed off at the top by a separate cover plate or by a support body on which the needle bar 7 is fastened. By means of this construction it becomes clear that the invention allows cleaning of a needle bar 7 with compressed air without it being necessary to substantially depart from the customary design of such a needle bar 7, such as described in U.S. Pat. No. 4,928,356 in detail.

Figure 4:
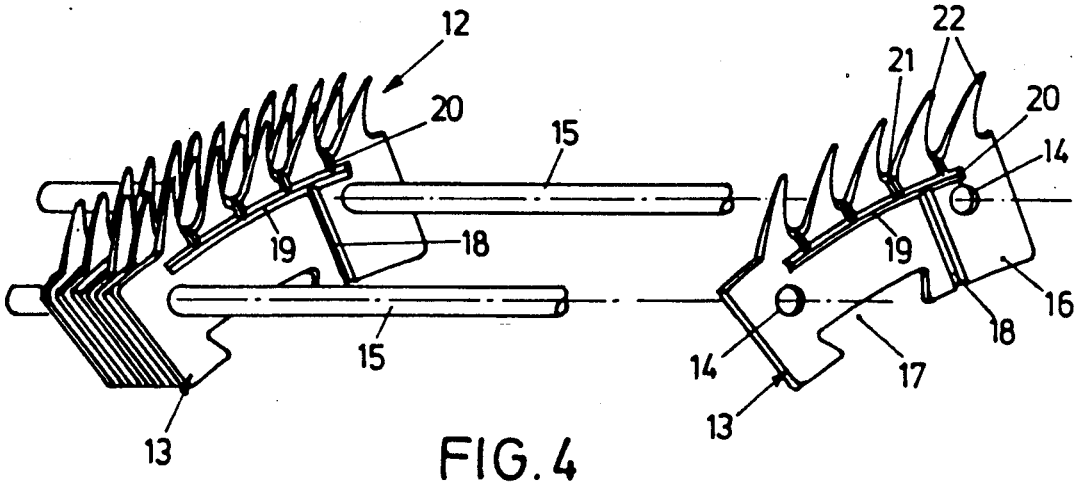
FIG. 4 is a partial perspective view of a stamped sawtooth element bar in accordance with the invention, having stamped sawtooth elements designed in accordance with the invention.

A bar 12 is shown in FIG. 4, which is formed by a plurality of stamped sawtooth elements 13 aligned next to each other. Each stamped sawtooth element 13 has two bores 14 and thus can be pushed on two rod-shaped support elements 15. A dovetail-shaped recess 17 is provided in the foot area 16 of each stamped sawtooth element 13 so that the entire bar 12 can be fastened on a support body, such as described in detail in German Patent 30 07 245.

The stamped sawtooth elements of the present invention have a compressed air supply channel 18 extending approximately radially through the foot area 16, a compressed air distribution channel 19 and a plurality of compressed air channels 20 branching off the compressed air distribution channel 19 and each terminating in the valley 21 between two teeth 22 of the stamped elements 13. These air channels 8 can be provided on only one side of each element 13 or they can be provided on both sides of the stamped elements 13, so that in this latter construction when two stamped elements 13 are joined, each of the grooves provided combines into a closed air channel. In this way a particularly effective removal of deposits in the area of the valleys 21 between the teeth 22 is achieved. Alternatively, the air channels 20 extend along the lengths of the teeth, or both between the teeth and along the lengths of the teeth.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A combing element for spinning machines, in particular a needle, where compressed air can be fed into an area of combing tips, wherein the combing element is provided with at least one compressed air channel in the shape of a groove (4) in the combing element itself, leading from a fastening area in the direction of the tip area (3).

2. A combing element in accordance with claim 1, wherein said combing element is in the form of a combing needle, and wherein said needle (1) has an essentially rectangular cross-section and said grooves (4) are cut parallel to a longitudinal axis of the needle (1) from the direction of two oppositely located longitudinal sides of the cross section.

3. A combing element in accordance with claim 2, wherein said grooves (4) extend from a shank end (5) of the needle (1) as far as said tip area (3).

4. A combing element in accordance with claim 2, wherein said grooves (4) have a cross-sectional shape of a shallow V or of a segment of a parabola, and wherein longitudinally extending, nondeformed edge areas (6) remain laterally to the grooves (4).

5. A combing element in accordance with claim 2, wherein the grooves (4) are formed in such a way that, when a plurality of said needles (1) are lined up, a closed compressed air channel (8) is formed between adjacent needles extending from a shank end (5) as far as the area of the tips (3).

6. A needle bar in accordance with claim 1, comprising a plurality of needles and a cover plate on each side of thereof, wherein compressed air is supplied to the compressed air channel (8) between the cover plates (9, 10) extending crosswise to the longitudinal direction of the needles (1) and extending upwardly beyond shank ends of said needles.

* * * * *